United States Patent [19]

Solloway

[11] 4,416,451

[45] Nov. 22, 1983

[54] AQUATIC EXERCISE ASSEMBLY

[76] Inventor: Daniel S. Solloway, 1315 18th St., Woodward, Okla. 73801

[21] Appl. No.: 310,788

[22] Filed: Oct. 13, 1981

Related U.S. Application Data

[63] Continuation-in-part of Ser. No. 79,966, Sep. 28, 1979, Pat. No. 4,311,306.

[51] Int. Cl.[3] ..... A63B 21/00

[52] U.S. Cl. ..... 272/116; 272/94; 272/67; 272/130; 2/161 A; 273/26 B

[58] Field of Search ..... 273/26; 272/130, 143, 272/116, 93, 67, 68, 71; 46/91 R

[56] References Cited

U.S. PATENT DOCUMENTS

| | | | |
|---|---|---|---|
| 373,692 | 11/1887 | Shaaber | 272/130 |
| 3,427,022 | 2/1969 | Ward | 46/91 X |
| 3,463,492 | 8/1969 | White | 273/67 R |
| 3,809,397 | 5/1974 | Gruenewald | 273/26 B |
| 4,300,759 | 11/1981 | Caplan | 272/116 |

FOREIGN PATENT DOCUMENTS

| | | | |
|---|---|---|---|
| 13630 | of 1911 | United Kingdom | 272/130 |

*Primary Examiner*—Richard J. Apley
*Assistant Examiner*—William R. Browne
*Attorney, Agent, or Firm*—Thomas W. Tolpin

[57] ABSTRACT

An exercise assembly for use in water. The assembly has an elongated shaft supporting a plurality of fins at one end. During an exercise the user grips the shaft and forces the fins through the water which offers a resistance to movement of the fins.

16 Claims, 19 Drawing Figures

100
102
104
106
106
106

110
112
114
116
118

120
122
124

126a
126b
128
130
132
134
136
138
140

142
144
146
148
149
150
151
152
154

160
162
164
164a
166
170
172
174

Fig. 14.
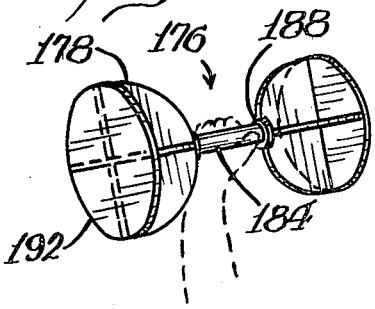
Fig. 15.
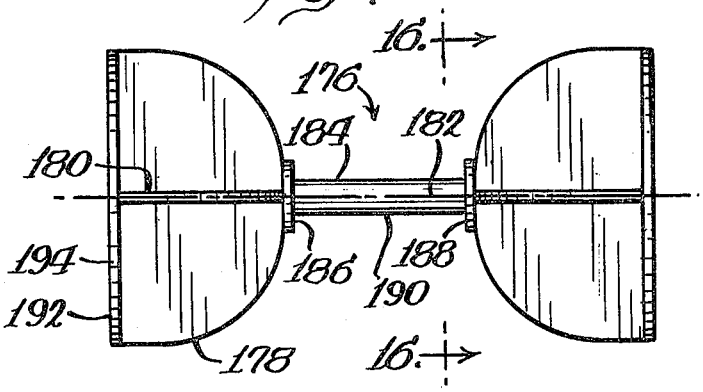
Fig. 16.
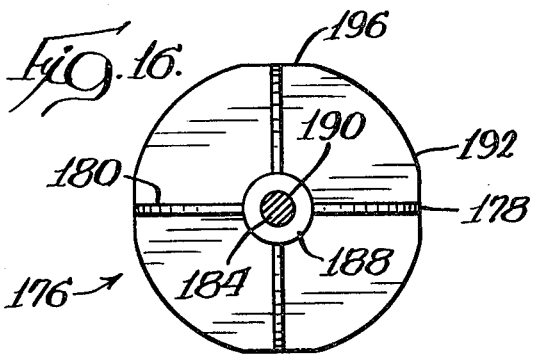
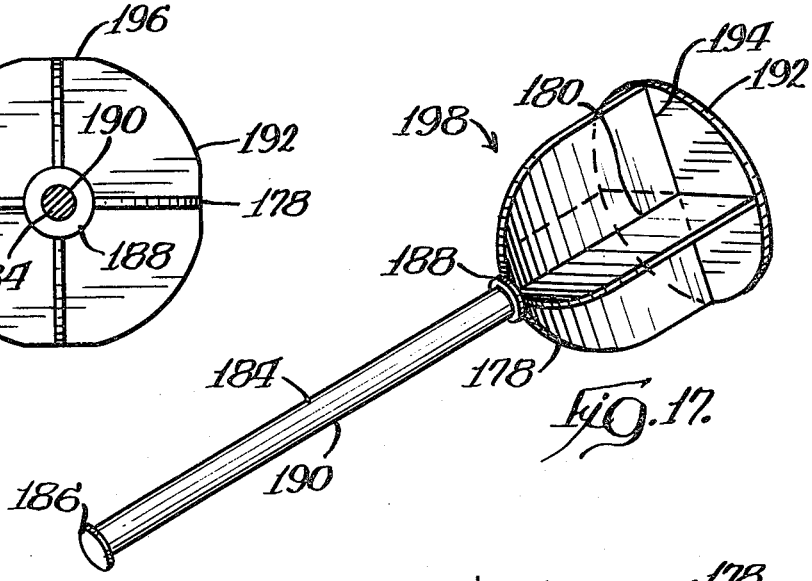
Fig. 17.
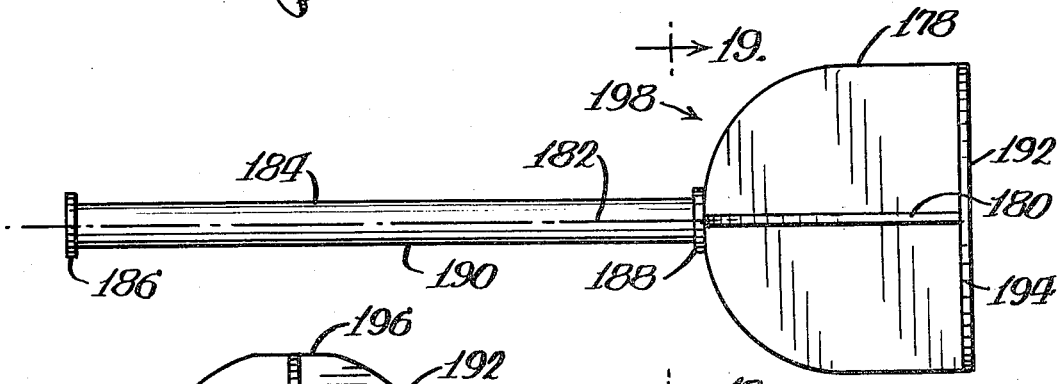
Fig. 18.
Fig. 19.
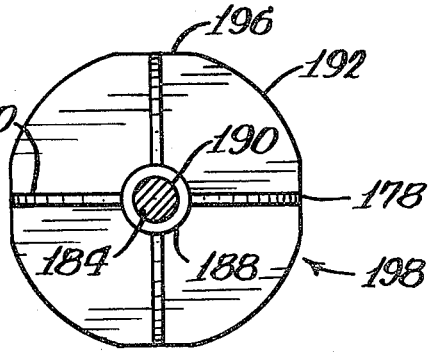

AQUATIC EXERCISE ASSEMBLY

CROSS REFERENCES TO RELATED APPLICATIONS

This application is a continuation-in-part of application Ser. No. 79,966, filed Sept. 28, 1979, now U.S. Pat. No. 4,311,306, issued Jan. 19, 1982, for an aquatic exercise assembly.

BACKGROUND OF THE INVENTION

This invention relates to an exercise assembly, and more particularly, to an exercise assembly for use in water.

Over the years, a variety of weight lifting and exercise devices such as barbells, have been developed. Typifying these weight lifting and exercise devices and other devices are those shown in U.S. Pat. Nos. 373,692; 654,097; 660,962; 717,041; 1,366,200; 1,676,689; 2,143,337; 3,260,523; 3,427,022; 3,671,988; 3,889,306; 4,029,312; 4,227,273; U.S. Pat. Nos. Des. 1,906,056 and 495,769; German Pat No. 351,627 and Italian Pat. No. 615,402. These weight lifting and exercise devices have met with varying degrees of success.

Many of the conventional weight lifting and exercise devices, however, are relatively awkward, cumbersome and complex and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional exercise devices exert an excess amount of torque and torsion (twist) on the joints of the user and are, therefore, not usually suitable for many types of physical therapy.

It is therefore desirable to provide an exercise assembly which overcomes most, if not all, of the above disadvantages.

SUMMARY OF THE INVENTION

An improved exercise assembly is provided for use in water to strengthen muscles, improve muscle tone, and enhance muscular coordination. Advantageously, the exercise assembly is readily usable by men, women and children alike, having different strengths and physical capabilities without substantial modification.

The exercise assembly of this invention is particularly useful for physical therapy in water because the torque, torsion and resistant forces which it exerts on the joints of the patient can be readily controlled by the physical therapist, by simply varying the acceleration or momentum of the aquatic exercise assembly to the desired amount. Desirably, the aquatic exercise assembly is easy to use and is relatively simple in design and construction for economy of manufacture.

To this end, the aquatic exercise assembly has an elongated generally impact-resistant water-engageable shaft or bar formed of a substantially water-impermeable material, such as lightweight aluminum or impact-resistant plastic. The shaft is constructed and arranged for movement in the water and has a manually grippable handle portion for being grasped under water.

In order to deflect the water and create a pressure head and fluid resistance to water flow as the shaft is moved in the water, at least one hydrodynamic resistance assembly (i.e., an assembly which exerts a fluid resistance or pressure head as it is moved through the water), which preferably takes the form of blades or fins or a spherical hollow shell with an internal ball, is coaxially and operatively connected to the water-engageable shaft along its axis. The hydrodynamic resistance assembly has a water-impingement surface with a cross-sectional area for positioning generally normal to the direction of movement of the shaft to hydrodynamically engage the water. The cross-sectional area of the water-impingement surface spans a width in the radial direction (i.e., in a direction generally transverse to the axis of the shaft) substantially greater than the shaft's width to enlarge or intensify the water resistance of the water-impingement surface.

The hyydrodynamic resistance assembly and its water-impingement surface are spaced an effective distance from the manual grippable handle portion of the shaft to exert a hydrodynamic torque (i.e., a torque exerted during movement through the water) on the handle portion as the shaft is being moved through the water.

In the preferred form, the hydrodynamic resistance assembly has at least one water-engageable blade or fin that extends radially from the shaft. Preferably, at least one transverse blade or fin is connected to the shaft and positioned generally normal or perpendicular to the water-engageable blade to create an axial pressure head and fluid resistance when the shaft is axially moved in the water.

In another form, the hydrodynamic resistance assembly includes at least one generally spherical water-engageable hollow shell that is secured to the shaft. Desirably, an internal ball is hydro-rotatably positioned within the shell (i.e., positioned to rotate within the shell during movement of the exercise assembly in the water). The internal ball has a plurality of fluid-flow openings or holes that are in fluid communication with holes or apertures in the outer shell for passage of water through the shell and internal ball.

In one embodiment, the aquatic exercise assembly is in the form of an aquatic barbell-like device, with blades or balls on opposite ends. When an outer shell and internal ball are used, the water-engageable shaft is preferably tubular to define a fluid-flow passageway in fluid communication with the balls and shells at the opposite ends of the shaft.

In another embodiment, the aquatic exercise assembly is generally in the form of a baseball bat.

In a further embodiment, the aquatic exercise assembly is generally in the form of a golf club.

In a still further embodiment, the aquatic exercise assembly is generally in the form of a racquet or paddle, such as a tennis racquet, racquetball racquet, lacrosse racquet, squash racquet, etc. The aquatic exercise assembly can also take other forms, such as a hockey stick, polo mallet, etc.

The aquatic exercise device can further be used in conjunction with a helmet to exercise the neck of a patient, or can be strapped onto the legs of the user to strengthen his leg muscles. It can be used with a glove for karate-like exercises and in conjunction with a hoop and shoulder straps for improving waist muscles. The aquatic exercise assembly can also be used in conjunction with other devices for strengthening other muscles.

A more detailed explanation of the invention is provided in the following description and appended claims taken in conjunction with the accompanying drawings.

BRIEF DESCRIPTION OF THE DRAWINGS

FIG. 14 is a perspective view of another barbell-like blade type of aquatic exercise assembly in accordance with principles of the present invention;

FIG. 15 is an enlarged front view of the aquatic exercise assembly of FIG. 14;

FIG. 16 is a cross-sectional view of the aquatic exercise assembly of FIG. 14 taken substantially along line 16—16 of FIG. 15;

FIG. 17 is a perspective view of another aquatic exercise assembly in accordance with principles of the present invention;

FIG. 18 is a front view of the aquatic exercise assembly of FIG. 17; and FIG. 19 is a cross-sectional view of the aquatic exercise assembly of FIG. 17 taken substantially along line 19—19 of FIG. 18.

DETAILED DESCRIPTION OF THE ILLUSTRATIVE EMBODIMENTS

Figure 1:
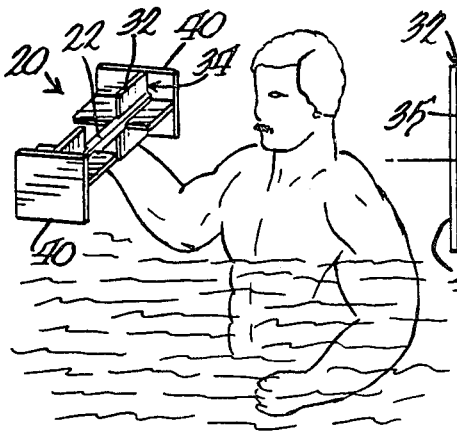
FIG. 1 is a perspective view of a barbell-like blade (fin) type of aquatic exercise assembly being lowered into the water by a weight lifter in accordance with the principles of the present invention.
Figure 2:
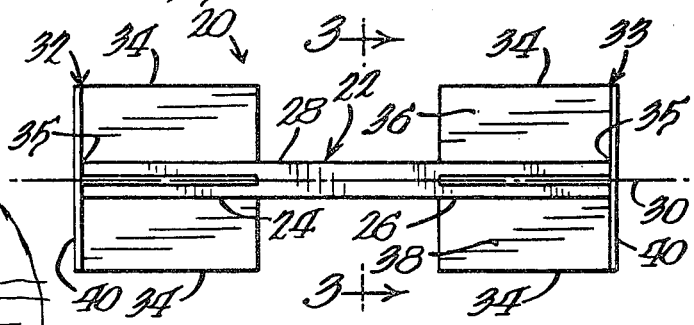
FIG. 2 is an enlarged front view of the aquatic exercise assembly of FIG. 1.
Figure 3:
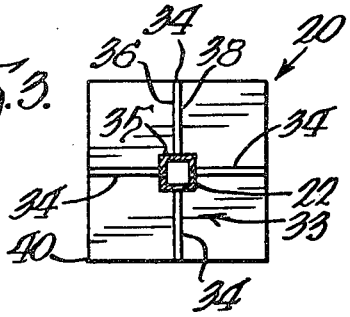
FIG. 3 is a cross-sectional view of the aquatic exercise assembly of FIG. 1 taken substantially along line 3—3 in FIG. 2.

Referring now to FIGS. 1–3 of the drawings, a barbell-like blade or fin type of aquatic exercise assembly 20, sometimes referred to as an "aquatic exerciser", is shown for use in water by weight lifters, patients, paraplegics, and other persons desirous of strengthening their muscles, improving their muscle tone, and enhancing their muscular coordination. Exercise assembly 20 is helpful to improve the cardiovascular system and general physical well being and strength of the user.

Exercise assembly 20 is particularly useful to physical therapists because it permits a greater range of motion in the water than conventional barbells and many other types of conventional weight lifting and exercise devices that are used on land, such as in gymnasiums, and because it permits the physical therapist to control the magnitude of the forces, torque and torsion exerted by the assembly on the patient, while minimizing harsh impact forces and shock on the patient's joints. Such control can be exercised by selectively varying the acceleration or momentum of the assembly to the desired amount. Advantageously, exercise assembly 20 can be used by men, women and children of various strengths and abilities without changing, adding, or removing parts and components.

Structurally, exercise assembly 20 has a water-engageable shaft, rod or bar 22 that is formed of a substantially water-impermeable and impact-resistant material, such as lightweight aluminum or impact-resistant plastic. Shaft 22 has a left-hand blade receiving portion 24 (FIG. 2) at one end, and a right-hand blade-receiving portion 26 at the other end. A manually grippable handle portion 28 is positioned intermediate and between and connects blade-receiving portions 24 and 26. In the embodiment shown, shaft 22 has a square cross section to facilitate gripping and is tubular to minimize weight and reduce construction costs.

In the illustrative embodiment, shaft 22 is generally rigid or stiff with the handle portion 28 spanning a length somewhat greater than the span of two hands so that it can be gripped by either one or two hands. While the illustrated embodiment is preferred, in some circumstances, it may be desirable that shaft 22 be solid or of a different shape, such as being cylindrical with knurled or other finger gripping portions, or that shaft 22 be more flexible or that handle portion 28 be somewhat larger or smaller.

Shaft 22 is elongated and is generally straight or linear so as to extend along axis 30 (FIG. 2). Shaft 22 has a width taken in a radial direction that is generally transverse to axis 30.

Shaft 22 also serves to rigidify and connect a pair of diametrically opposed hydrodynamic resistance assemblies 32 and 33 that are coaxially connected and secured to blade-receiving portions 24 and 26, respectively, of shaft 22. Each hydrodynamic resistance assembly 32 and 33 has a plurality of angularly disposed water-engageable radial blades or fins 34. Blades 34 extend radially from bar 22 and serve to deflect water and create a pressure head and fluid resistance to water flow as shaft 22 is moved in or through the water. Blades 34 are generally planar or flat and are formed of the same material as shaft 22. Preferably, there are at least two pairs of diametrically opposed blades 34 at each end of shaft 22. In the preferred embodiment, each of the two sets of diametrically opposed blades 34 are positioned generally perpendicular or at right angles to each other and each of the adjacent blades 34 cooperate with each other to define an angular aquatic pocket 35 for cuppingly engaging water as shaft 22 is moved in the water.

Each of the radial blades 34 has a pair of opposed generally flat water-impingement surfaces 36 and 38 which have a generally rectangular cross-sectional area. In use, one of the water-impingement surfaces 36 or 38 is positioned generally normal or perpendicular to the direction of movement of shaft 22 to hydrodynamically engage the water as shaft 22 is moved in the water. Water-impingement surfaces 36 and 38 span a radial width or height that is substantially greater than the width of shaft 22, taken in a direction transverse to axis 30, to increase or intensify the water resistance of the water-impingement surfaces. The water resistance (resistive forces) exerted by blades 34 as shaft 22 is moved in the water can be increased by increasing the radial span or height of blades 34 and thereby enlarging the effective cross-sectional area that is positioned generally normal to the direction of movement of shaft 22.

The blades 34 of each of the hydrodynamic resistance assemblies 32 and 33, respectively, are spaced an effective distance from the handle portion 28 of shaft 22 to exert a hydrodynamic torque on handle portion 28 as shaft 22 is moved in or through the water so as to strengthen the muscles of the user of aquatic exercise assembly 20. If the user's hand is held in the middle of shaft 22 and shaft 22 is not rotated or pivoted, the torque exerted by the blades extending from the left-hand side of shaft 22 will counterbalance and offset the torque exerted by blades extending from the right-hand side of shaft 22.

A transverse blade or fin 40 is secured to each end of shaft 22 at a position generally normal to and abuttingly engaging radial blades 34. Transverse blades 40 create an axial pressure head and fluid resistance to the water when shaft 22 is moved axially in or through the water. In the illustrative embodiment, transverse blade 22 is positioned axially outward of radial blades 32, and is generally rectangular and generally planar or flat. In some circumstances, it may be desirable to position transverse blades 40 axially inwardly of radial blades 34.

While the illustrated embodiment is preferred, it may be desirable in some circumstances, however, that there are more or less blades at each end of the shaft or at different angles, or that the blades be curved or twisted or of a different shape or formed of a different material.

In use, the aquatic exercise assembly 20 is moved or swung in the water at a selected acceleration and momentum to create the desired resistance, torque and torsion upon the arms of the person using the exercise assembly.

Figure 4:
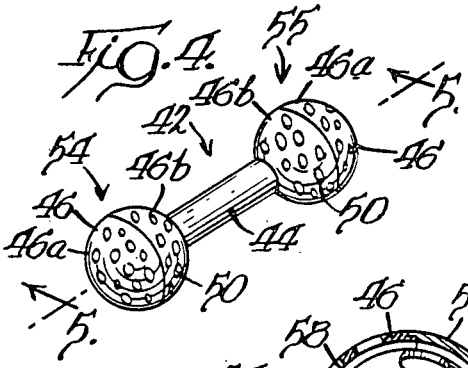
FIG. 4 is a perspective view of a barbell-like ball type of aquatic exercise assembly in accordance with principles of the present invention.
Figure 5:
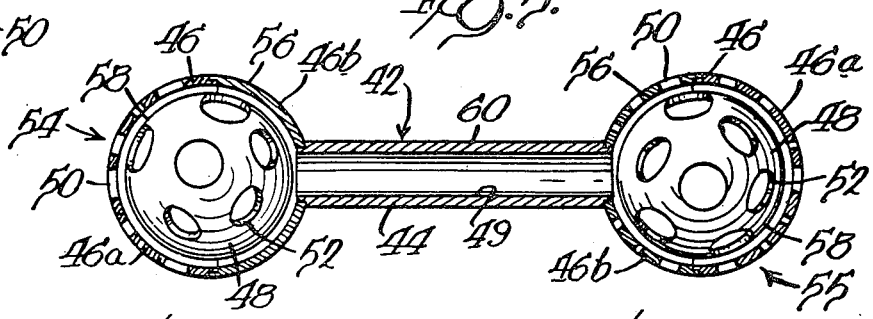
FIG. 5 is an enlarged cross-sectional view of the aquatic exercise assembly of FIG. 4 taken substantially along the line 5—5 of FIG. 4.

Referring now to FIGS. 4 and 5, a barbell-like ball type of aquatic exercise assembly 42 is shown for use in water. Ball type exercise assembly 42 is similar to blade type exercise assembly 20 (FIGS. 1–3) except that each of the ends of the water-engageable shaft or rod 44 securely carries a generally spherical water-engageable outer hollow shell 46 that houses an internal hollow ball 48 and shaft 44 defines a fluid-flow passageway 49 in fluid communication with the outer shells 46 and internal balls 48. Each outer shell 46 is coaxially and fixedly connected to the end of bar 24 and defines a plurality of fluid-flow apertures or holes 50 therein. Outer shell 46 is preferably made of two semi-spherical complementary cup-like parts **46*a* and 46*b* (FIG. 4**) which are detachably connected to each other, such as by complementary threads, snaps or tabs.

Internal ball 48 is hydro-rotatably positioned within its associated shell 50 and defines a plurality of fluid-flow openings or holes 52 that are positioned in fluid communication with shell apertures 50 to accommodate passage of water through the internal ball 48 and outer shell 46 as the exercise assembly 42 is moved in the water. Each internal ball 48 and its associated outer shell 46 cooperate with each other to provide a hydrodynamic resistance assembly 54 or 55 that deflects water flow as shaft 44 and exercise assembly 42 are moved in the water.

Outer shell 46 and internal ball 48 are each preferably formed of a substantially water-impermeable impact-resistant material, such as aluminum or impact resistant plastic, as is shaft 44. Outer shell 46 and internal ball 48 each provide a water-impingement surface 56 and 58 (FIG. 5), respectively, with a circular cross-sectional area for positioning generally normal or perpendicular to the direction of movement of shaft 44 in the water. Water-impingement surfaces 56 and 58 hydrodynamically engage the water as exercise assembly 42 is moved in or through the water.

The diameter of the outer shell's water-impingement surface 56 is substantially greater than the width of shaft 44 to increase or intensify the water resistance of outer shell 46. In the preferred form of ball type of exercise assembly 42 (FIGS. 4 and 5), internal ball 48 is slightly smaller than outer shell 46 and has a circular cross-sectional area of a diameter substantially greater than the width of shaft 44 to enhance the water-resistance of hydrodynamic resistance assemblies 54 and 55.

The outer shell 46 and internal ball 48 of each hydrodynamic resistance assembly 54 and 55 are spaced an effective distance from the manually grippable handle portion 60 of shaft 44 to exert a hydrodynamic torque on the handle portion 60 as shaft 44 is moved in or through the water. If the user's hands are held in the middle of shaft 44 and shaft 44 is not rotated or pivoted, the torque exerted by each hydrodynamic resistance assembly 54 and 55 counterbalance and offset each other.

The ball type of aquatic exercise assembly 42 (FIGS. 4 and 5) provides many similar advantages as the blade type of aquatic exercise assembly 20 (FIGS. 1–3) and is used in a similar manner. As shaft 44 is moved or swung in the water, internal balls 48 rotate or spin within the interior of shells 46.

Figure 6:
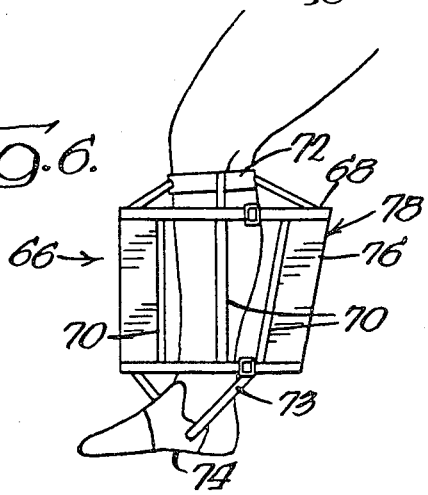
FIG. 6 is a perspective view of a blade-type aquatic leg exercise assembly that has been strapped onto the exerciser's leg in accordance with principles of the present invention.

The blade or fin type of aquatic leg exercise assembly 66 shown in FIG. 6 is similar in many respects to the blade type of barbell exercise assembly 20 shown in FIGS. 1–3. Exercise assembly has a flexible frame structure or assembly 68 connected to a plurality of elongated circumferentially spaced, generally upright shafts or bars 70. Frame 68 has an upper flexible strap 72 for connection to the person's leg and has lower flexible straps 73 connected to a stirrup 74 that fits upon the person's foot. Straps 72 and 73 and shafts 70 provide manually grippable handle portions which are readily graspable by the user of the exercise assembly 66. Each upright shaft 70 is axially connected to a generally upright water-engageable blade or fin 76. Each blade is preferably generally flat or planar with a rectangular shape. In some circumstances, however, it may be desirable that the blades be curved or of a different configuration. Collectively, blades 76 provides a hydrodynamic resistance assembly 78 to deflect water and create a pressure head and fluid resistance to water flow as the exercise assembly 66 is moved in the water.

Figure 7:
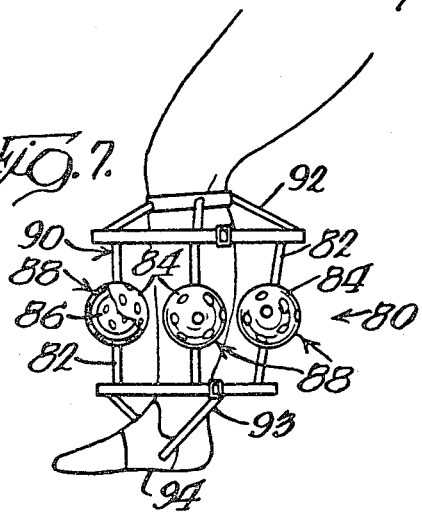
FIG. 7 is a perspective view of a ball-type aquatic leg exercise assembly with portions shown in cross-section in accordance with principles of the present invention.

The ball type of aquatic leg exercise assembly 80 shown in FIG. 7 is similar to blade type of aquatic leg exercise assembly 66 shown in FIG. 6, except that each shaft or bar 82 securely carries at least one water-engageable hollow outer shell 84 that houses an internal hollow ball 86. Each outer shell 84 and internal ball 86 are structurally and functionally similar to the shells 46 and balls 48, respectively, of the barbell-like exercise assembly 42 shown in FIGS. 4 and 5, and provide a hydrodynamic resistance assembly 88. Frame 90, straps 92 and 93 and stirrup 94, respectively, are substantially identical to the frame 68, straps 72 and 73 and stirrup 74 shown in FIG. 6.

Figures 8, 9, 10, 11, 12, 13:
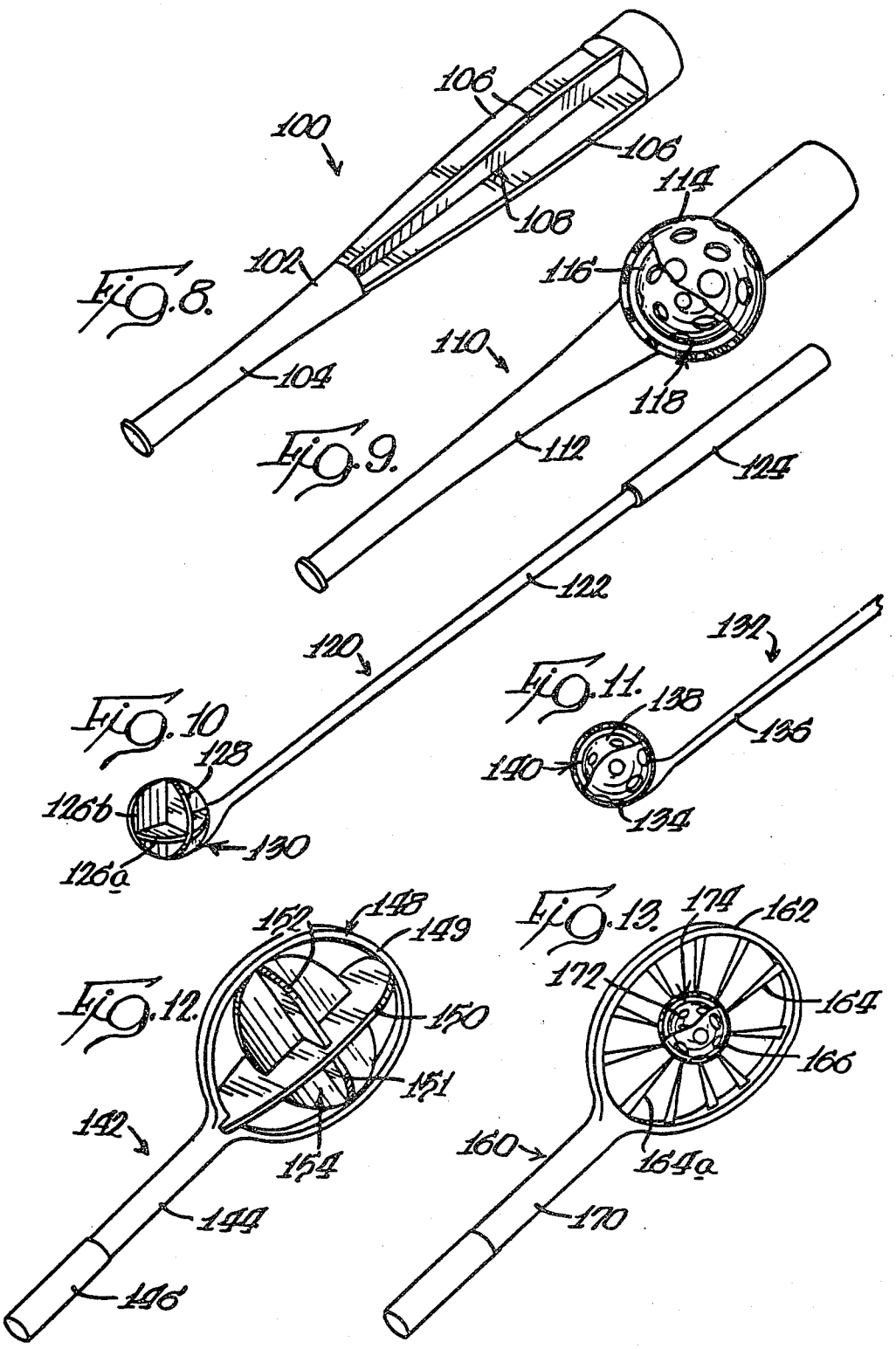
FIG. 8 is a perspective view of a bat-like blade-type of aquatic exercise assembly in accordance with principles of the present invention.
FIG. 9 is a perspective view of a bat-like ball-type of aquatic exercise assembly with portions shown in cross section in accordance with principles of the present invention.
FIG. 10 is a perspective view of a golf club-like blade type of aquatic exercise assembly in accordance with principles of the present invention.
FIG. 11 is a fragmentary perspective view of a golf club-like ball type of aquatic exercise assembly with portions shown in cross section in accordance with principles of the present invention.
FIG. 12 is a perspective view of the racquet-like blade type of aquatic exercise assembly in accordance with principles of the present invention.
FIG. 13 is a perspective view of a racquet-like ball type of aquatic exercise assembly with portions shown in cross section in accordance with principles of the present invention.

The bat-like blade type of aquatic exercise assembly 100 of FIG. 8 has a generally solid water-engageable shaft 102. Shaft 102 is in the form of a baseball bat or club with a manually grippable handle portion 104. Exercise assembly 100 has two sets of diametrically opposed generally flat blades or fins 106 that provide a hydrodynamic resistance assembly 108. Blades 106 are tapered inwardly towards handle 104 and are positioned at right angles to each other. Blades 106 operate in the water similarly to the radial blades 32 of the barbell-type aquatic exercise assembly 20 shown in FIGS. 1–3. If desired, curved blades, or blades having a different shape, or blades positioned at a different angular relationship can be used.

The bat-like ball-type of aquatic exercise assembly 110 shown in FIG. 9 is similar to the bat-like aquatic exercise assembly 100 shown in FIG. 8, except that the outer end of the bat-like water-engageable shaft 112 securely carries a water-engageable hollow outer shell 114 that houses an internal hollow ball 116. Outer shell 114 and internal ball 116 are structurally and functionally similar to shells 46 and ball 48, respectively, of barbell-like exercise assembly 42 (FIGS. 4 and 5) and cooperate together to provide a hydrodynamic resistance assembly 118.

The golf club-like blade type of aquatic exercise assembly 120 shown in FIG. 10 has an elongated water-engageable shaft or shank 122 in the form of a golf club with a manually grippable handle portion 124 and blades or fins **126*a*, 126*b*, and 128 that cooperate with each other to provide the head of the club. The blades include a semi-circular axial blade 126*a* and a generally circular axial blade 126*b*, that are positioned at right angles to each other, as well as a transverse semi-circular blade 128. The transverse blade 128 abuts against, intersects, and is positioned generally normal to axial blades 126*a* and 126*b*. Blades 126*a*, 126*b* and 128 cooperate with each other to provide a hydrodynamic resistance assembly 130 and function similarly to blades 32 and 40, respectively of the barbell-like exercise assembly 20 shown in FIGS. 1–3**.

The golf club-like ball type aquatic exercise assembly 132 of FIG. 11 is similar to the golf club-like aqautic exercise assembly 120 of FIG. 10, except that the head at the end of shaft or shank 136, contains a water-engageable hollow outer shell 134 that houses an internal hollow ball 138, in lieu of blades. Outer shell 134 is securely connected to the end of shaft 136, while internal ball 138 is free to rotate and spin within the interior of shell 138 as the exercise assembly 132 is moved in the water. Outer shell 134 and internal ball 138 are structurally and functionally similar to the shells 46 and balls 48, respectively, of barbell-like exercise assembly 42 (FIGS. 4 and 5) and cooperate with each other to provide a hydrodynamic resistance assembly 140.

The racquet-like blade type of aquatic exercise assembly shown in FIG. 12 has a shaft or shank 144 in the form of a racquet with a manually grippable handle portion 146 and a racquet-like head 148. Racquet-like aquatic exercise assembly 142 (FIG. 12) can be in the form of a tennis racquet, racquetball racquet, lacrosse racquet, squash racquet, jai alai racquet, paddle, etc. Head 148 has an elliptical rim 149 that is connected to two water-engageable generally elliptical axial blades or fins 150 and 151, and a generally elliptical transverse fin 152. Axial blade 150 is secured to the upper end of shaft 144 and spans a greater length than the other blades 151 and 152. Blades 150, 151, and 152 function similarly to blades 32 and 49, respectively, of the barbell-like exercise assembly 20 (FIGS. 1–3) and provide a hydrodynamic resistance assembly 154.

Referring now to FIG. 13, the racquet-like ball type aquatic exercise assembly 160 shown therein is similar to the racquet-like blade type aquatic exercise assembly 142 (FIG. 12) except that racquet head 162 has radial spokes 154 that are secured to a water-engageable hollow outer shell 166, in lieu of blades. Outer shell 166 is axially secured to shaft or shank 170, via axial spoke **164*a*, and houses an internal hollow ball 172. Outer shell 166 and internal ball 172 are structurally and functionally similar to the shells 46 and balls 48, respectively, of the barbell-like exercise assembly of FIGS. 4 and 5, and cooperate with each other to provide a hydrodynamic resistance assembly 174**.

Referring now to FIGS. 14–16, the barbell-like or dumb bell-like blade type aquatic exercise assembly 176 shown therein provides an aquatic dumb bell which is similar to the barbell-like aquatic exercise assembly 20 shown in FIGS. 1–3 except that the radial fins 178 have axial engaging portions 180 extending across their entire length which are secured to and touch each other in coaxial alignment with the axis 182 of shaft 184 and are secured to and extend radially outward of fin-engageable end portions or butts 186 and 188 at the end of the shaft. Fin-engageable end portions 186 and 188 have a transverse or diametric thickness or height greater than the manually grippable portion 190 of shaft 182. Transverse fins or end plates 192 abut flush against and are secured to the outer transverse radial edges 194 of radial fins 178.

In the embodiment shown in FIGS. 14–16, transverse fins 192 are circular, radial fins 178 are the shape of a quadrant or a quarter of a circle, end portions 186 and 188 of shaft 184 are circular discs, and shaft 184 is cylindrical. Circular fins 192 can have flat portions 196 (FIG. 16) which are spaced apart from each other to minimize rolling when the exercise assembly is laid on the floor or a pool deck. Transverse and radial fins 192 and 178, as well as end portions 186 and 188, can also be rectangular, preferably square, with rounded corners to avoid scratching or accidentally puncturing the skin and enhance safety. Shaft 184 can have a square or polygonal cross-section and can be solid or tubular.

Fins 192 and 178 each have a generally planar or flat, imperforate water-impermeable cross-sectional area. The maximum height of radial fins 178 are more than twice the maximum thickness of the manually grippable portion 190 of shaft 184. Transverse fin 192 spans a distance at least as great as the maximum diametric span or height of the radial fins 178 and occupies an area enclosing the radial fins.

In the embodiment shown in FIGS. 14–16, there are two sets of diametrically opposed radial fins 178 at each end of the shaft 184 which are positioned generally at right angles to each other to define angular aquatic pockets to cupplingly engage water as the aquatic exercise assembly is moved in the water. It may be desirable in some circumstances that there be more or less radial fins or radial fins spaced at greater or less than right angles to each other or that the radial fins be curved or twisted or have some other shape. Auxiliary fins can be bolted, clamped or otherwise secured to the radial fins and transverse fins to increase the effective height of the fins. The aquatic exercise assembly 176 can come in various sizes with larger sizes for men and more compact and smaller sizes for women and children.

The aquatic exercise assembly 198 shown in FIGS. 17–19 is substantially similar to the exercise assembly 176 shown in FIGS. 14–16, except that the radial fins 178 are secured to only one end, end portion 188, of shaft 184. Shaft 184 and fins 178 can be very long or relatively short with respect to each other depending on the preference of the user. Exercise assembly 176 provides an aquatic bat for a baseball player, an aquatic tennis racquet for a tennis player, an aquatic racquetball racquet for a racquetball player, and an aquatic golf club for a golfer.

It can, therefore, be seen that each of the embodiments shown in FIGS. 1–19 has a generally impact-resistant water-engageable shaft formed of a substantially water-impermeable material with a manually grippable handle portion for being grasped under water. Each of the above embodiments has at least one hydrodynamic resistance assembly that is coaxially and operatively connected to the shaft along its axis to deflect water and create a pressure head and fluid resistance to water flow as the shaft is moved in and through the water. Each hydrodynamic resistance assembly has a water-impingement surface with a cross-sectional area for positioning generally normal to the direction of movement of the shaft. The cross-sectional area of the water-impingement surface spans a width, taken in a direction generally transverse to the shaft, that is substantially greater than the width of the shaft to increase the water resistance of the water-impingement surface. Each hydrodynamic resistance assembly and its water-impingement surface is spaced an effective distance away from the manually grippable handle portion of the shaft to exert a hydrodynamic torque on the handle portion as the shaft is being moved in or through the water.

While the ball type embodiments discussed above preferably have only one internal ball, it is to be understood that in some circumstances, it may be desirable to position more than one internal ball, either concentrically or adjacent each other, within each outer shell, or omit the internal ball.

While the above type of aquatic exercise assemblies are preferred, water-engageable surfaces of other shapes and configurations, such as a funnel-shaped surface or a semi-circular cup, can also be used to provide a hydrodynamic resistance assembly in accordance with the invention. Furthermore, the blades or fins, and the outer shell and internal balls of the present invention can be used with other devices, such as a helmet to strengthen the user's neck muscles, or a hoop and frame arrangement to strengthen the user's waist and torso muscles, or with a glove for karate-like exercises, etc.

Each of the above embodiments provide a wider range of movement in the water with less stress on the joints of the user than is attainable with most types of conventional barbells and other exercise devices that are used on land, and offers many advantages to physical therapists.

Although embodiments of the invention have been shown and described, it is to be understood that various modifications and substitutions can be made by those skilled in the art without departing from the novel spirit and scope of this invention.

What is claimed is:

1. An aquatic exercise assembly for use in water to strengthen muscles, improve muscle tone and enhance muscular coordination, comprising:

a generally impact-resistant water-engageable imperforate shaft formed of substantially water-impermeable material having a fin-engageable end portion and a manually grippable portion for being grasped under water adjacent said fin-engageable end portion, said shaft being elongated and extending in an axial direction along an axis, said manually grippable portion of said shaft having a maximum width defining a thickness taken in a radial direction generally transverse to said axis and said shaft being movable in said water; and a plurality of water-engageable fins providing a hydrodynamic resistance assembly secured to and extending generally radially outwardly from each fin-engaging end portion of said shaft, said fins being substantially rigid to substantially avoid radial deflection and being angularly disposed with respect to each other for deflecting water and creating a pressure head and fluid resistance to water flow as said shaft is moved in said water, each of said fins having an axial engaging portion extending the entire length of each fin along said axis, said axial engaging portions of said fins directly secured to and touching each other in coaxial alignement with said axis of said shaft, each of said fins having a height extending from said axial engaging portion of an outer extremity of said fin substantially greater than the maximum thickness of said manually grippable portion of said shaft for enhanced hydrodynamic resistance, each of said fins having a solid, generally planar water-impingement surface lying in the axial direction and extending continuously across said fin from said axial engaging portion to said outer extremity with an imperforate, water-impervious cross-sectional area to provide a solid barrier in coplanar relationship and alignment with said axis to hydrodynamically engage said water and said rigid fins being positioned an effective distance from said manually grippable portion of said shaft for exerting a hydrodynamic torque on said manually grippable portion of said shaft as said shaft is being moved in said water to strengthen the muscles of the user of the exercise assembly.

2. An aquatic exercise assembly in accordance with claim 1 wherein said planar surfaces of said fins are generally a quadrant of a circle.

3. An aquatic exercise assembly in accordance with claim 1 wherein said fins have rounded edges.

4. An aquatic exercise assembly in accordance with claim 1 wherein the height of each planar surface of each fin is substantially greater than the thickness of said shaft.

5. An aquatic exercise assembly in accordance with claims wherein the height of each planar surface of each fin is more than twice the thickness of said shaft.

6. An aquatic exercise assembly in accordance with claim 1 wherein the diameter of said fin-engaging end portion is substantially greater than the diamter of said manually grippable portion.

7. An aquatic exercise assembly in accordance with claim 6 wherein said fin-engaging end defines a circular disc.

8. An aquatic exercise assembly in accordance with claim 1 wherein said hydrodynamic resistance assembly has four fins with adjacent fins positioned at right angles to each other.

9. An aquatic exercise assembly in accordance with claim 1 wherein each of said fins has an outer transverse edge and said hydrodynamic resistance assembly has a generally planar transverse fin securely abutting against said outer transverse edges, said transverse fin located axially outwardly and generally normal to said plurality of fins and spanning a diametric distance at least as great as the maximum diametric span of any pair of said plurality of said fins and said transverse fin occupying an area enclosing said plurality of said fins as viewed from the end of said aquatic exercise assembly to enhance resistance to axial movement of said aquatic exercise assembly in said water.

10. An aquatic exercise assembly in accordance with claim 9 wherein said transverse fin is generally circular.

11. An aquatic exercise assembly for use in water to strengthen muscles, improve muscle tone and enhance muscular coordination, comprising:

a generally inpact-resistanct water-impermeable shaft formed of substantially water-impermeable material having at least one fin-engageable portion and a manually grippable portion for having grasped under water, said shaft being elongated and extending in an axial direction along an axis, said manually grippable portion of said shaft having a maximum width defining a thickness taken in a radial direction generally transverse to said axis and said shaft being moveable in said water; and a plurality of water engageable fins providing a hydrodynamic resistance assembly secured to and extending generally radially outwardly from said fin-engaging end portion of said shaft, said fins being angularly disposed with respect to each other to define angular aquatic imperforate pockets for cuppingly engaging and deflecting water and creating a pressure head and fluid resistance to water flow as said shaft is moved in said water, each of said fins having an axial engaging portion extending the entire length of each fin along said axis, said axial engaging portions of said fins secured to and directly touching each other in coaxial alignment with said axis of said shaft, each of said fins having a height extending from said axial engaging portion to an outer extremity of said fin substantially greater than the maximum thickness of said manually grippable portion of said shaft for enhanced hydrodynamic resistance, each of said fins having a substantially solid, water-impingement surface extending generally across said fin from said axial engaging portion to said outer extremity with portions lying in the axial direction and having an imperforate, water-impervious cross-sectional area to provide a solid barrier extending generally radially from said axis to hydrodynamically engage said water and said fins being positioned an effective distance from said manually grippable portion for exerting a hydrodynamic force on said manually grippable portion of said shaft as said shaft is being moved in said water to strengthen the muscles of the user of the aquatic exercise assembly.

12. An aquatic exercise assembly in accordance with claim 11 wherein said fins are each generally a quadrant of a circle.

13. An aquatic exercise assembly in accordance with claim 11 wherein the diameter of said fin-engaging end portion is substantially greater than the diameter of said manually grippable portion.

14. An aquatic exercise assembly in accordance with claim 13 wherein said fin-engaging end portion is a circular disc and said hydrodynamic resistance assembly includes four quadrant shaped fins secured to each other at right angles.

15. An aquatic exercise assembly in accordance with claim 11 wherein each of said fins has an outer transverse edge and said hydrodynamic resistance assembly has a generally planar transverse fin securely abutting against said outer transverse edges, said transverse fin located axially outwardly and generally normal to said plurality of fins and spanning a diametric distance at least as great as the maximum diametric span of any pair of said plurality of said fins and and said transverse fin occupying an area enclosing said plurality of fins as viewed from the end of said aquatic exercise assembly to enhance resistance to axial movement of said aquatic exercise assembly.

16. An aquatic exercise assembly in accordance with claim 15 wherein said transverse fin is circular.

* * * * *